US007507887B1

(12) United States Patent
Blanchard

(10) Patent No.: US 7,507,887 B1
(45) Date of Patent: Mar. 24, 2009

(54) PRECISION DOUBLE ACTING TRUSS FOR STRINGED MUSICAL INSTRUMENTS

(76) Inventor: Mark W. Blanchard, P.O. Box 2130, Eureka, MT (US) 59917

( * ) Notice: Subject to any disclaimer, the term of this patent is extended or adjusted under 35 U.S.C. 154(b) by 0 days.

(21) Appl. No.: 12/157,040

(22) Filed: Jun. 6, 2008

Related U.S. Application Data

(60) Provisional application No. 60/933,665, filed on Jun. 8, 2007.

(51) Int. Cl.
*G10D 3/00* (2006.01)

(52) U.S. Cl. ..... 84/293

(58) Field of Classification Search ..... 84/267, 84/293

See application file for complete search history.

(56) References Cited

U.S. PATENT DOCUMENTS 4,508,003 A * 4/1985 Smakula ..... 84/293
4,852,449 A * 8/1989 Zeitler ..... 84/293
6,259,008 B1 7/2001 Eddinger

* cited by examiner

*Primary Examiner*—Kimberly R Lockett

(57) ABSTRACT

A truss rod apparatus, for use within a stringed musical instrument, to correct both forward and backward bowing of the instrument's neck. The apparatus includes an elongate rod with an adjustor mechanism incorporating two axially oriented threaded sections of similar thread direction but differing thread pitches. In use, the adjustable rod is attached near its ends to a second elongate member. Turning the adjustor mechanism in either direction causes the threaded sections to advance at different rates, thereby causing a slight change in length of the rod. The change in length relative to the second elongate member, induces a bending force on the apparatus which in turn induces a corrective bending in the neck of the musical instrument into which the truss rod apparatus is embedded.

11 Claims, 2 Drawing Sheets

PRECISION DOUBLE ACTING TRUSS FOR STRINGED MUSICAL INSTRUMENTS

CROSS-REFERENCE TO RELATED APPLICATIONS

This application claims the benefit of provisional patent application Ser. No. 60/933,665, filed 2007 Jun. 8 by present inventor, which is incorporated by reference.

FEDERALLY SPONSORED RESEARCH

Not Applicable

SEQUENCE LISTING OR PROGRAM

Not Applicable

BACKGROUND

1. Field of Invention

This invention relates to stringed musical instruments, specifically to an improved apparatus for adjusting the curvature of the neck of a stringed musical instrument.

2. Prior Art

A stringed musical instrument needs a certain amount of curvature in the neck in order for the instrument to be properly playable. Due to variations in materials and design of the instrument's neck, the string tension alone does not always provide the right amount of neck curvature. A dual-acting truss rod assembly, embedded in the neck, is typically utilized to provide corrective adjustment, either forward or backward, of the curvature of the neck.

A common truss rod design is described in U.S. Pat. No. 6,259,008 to Eddinger (2001). In this design, opposing threads at opposite ends of the truss rod are utilized to allow adjustment in either a forward or backward direction. While this design does provide the required movement in both directions, the two threads working in opposite directions cause the truss rod to react very quickly to a given amount of rotation of the adjuster nut. The result is a truss rod that requires undue amounts of force to adjust and which is difficult to adjust precisely. Limitations in the strength of very fine threads make it impossible to achieve finer adjustment with this truss rod design.

U.S. Pat. No. 4,508,003 to Smakula (1985) describes a double acting truss rod which utilizes two differing thread pitches concentrically arranged on an adjuster bolt. This design offers dual direction adjustability and much finer adjustment capabilities. However, this thread arrangement requires considerable bulk resulting in a truss rod that is very large at the adjusting end. This limits the usefulness of this design to instruments with bulky necks or which allow the adjuster to operate from the end of the guitar neck attached to the body of the instrument. Many instruments do not meet these requirements thereby limiting the application of this design. In addition the adjuster mechanism is unduly complicated and costly to manufacture.

SUMMERY

This invention, an improved, dual-acting, precision truss rod, utilizes an elongate member with an adjuster mechanism for changing its length. When attached to a second elongate member, the change in length causes the truss rod to bend. The adjuster mechanism utilizes two, slightly different, thread pitches that operate in the same direction. This feature allows the adjuster mechanism to be turned with minimal force, and offers finer adjustment by reducing the amount of curvature induced in the truss rod for a given number of turns of the adjuster nut. Additionally, the two threaded sections are arranged axially rather than concentrically, thereby making the rod slim enough to use in instruments with slender necks that adjust at the end of the neck not connected to the body of the instrument.

Accordingly, several objects and advantages of the invention are to provide a dual-acting truss rod which operates with less force needing to be applied to the adjuster nut, allows finer adjustment by requiring the adjuster to be turned more to induce given amount of curvature, and is applicable to a wider range of stringed musical instruments due to its less bulky configuration. Further objects and advantages will become apparent from further study of the following description and the accompanying drawings.

DRAWINGS

Figure 1:
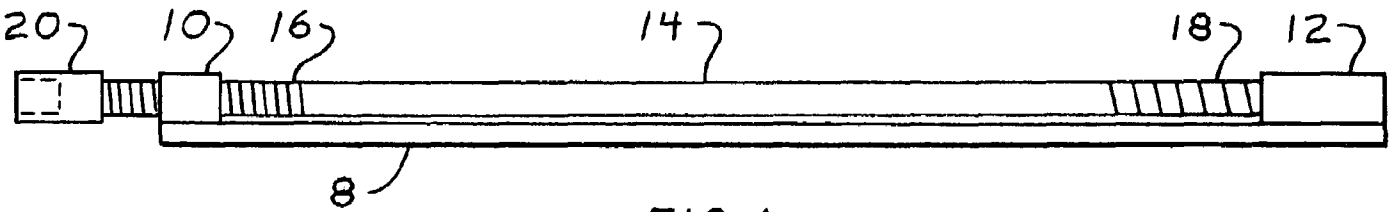
FIG. 1 is a side view of a first embodiment of my invention.

| DRAWINGS - Reference Numerals | |
|---|---|
| 8 bar | 10 first end block |
| 12 second end block | 14 rod |
| 16 first threaded section | 18 second threaded section |
| 20 adjuster nut | 22 collar |
| 24 instrument neck | |

DETAILED DESCRIPTION

First Embodiment, FIG. 1

FIG. 1 is a side view showing one embodiment of the invention. A rod 14 has a first threaded section 16 at one end, and a second threaded section 18 at the other end. The threaded sections 16, 18 are of similar thread direction but differ in thread pitch. The first threaded section 16 passes through a similarly threaded first end block 10. The second threaded section 18 is screwed into, but not all the way through, a similarly through threaded, second end block 12. The end blocks 10, 12 are fixedly attached, such as by welding or brazing, to opposite ends of a bar 8. An adjuster nut 20 is fixedly attached to the end of the first threaded section 16 of the rod 14. The adjuster bolt 20 may be engaged with a tool to facilitate turning it. Enough exposed thread is provided in all locations to allow the rod 14 to be turned several full revolutions in each direction.

Operation of First Embodiment, FIG. 1

In operation, the truss rod assembly of FIG. 1 is embedded into the neck of a stringed musical instrument. Turning the adjuster nut 20 in one direction causes the first and second threaded sections 16, 18 to advance in the same direction but at slightly differing rates through the first and second end blocks 10, 12. This in turn causes the length of the rod 14 between the end blocks 10, 12 to change slightly, thereby causing the bar 8 to bend. Reversing the direction in which the adjuster nut 20 is turned, causes the bar 8 to bend in the opposite direction. The bending of the bar 8 induces a similar bend in the neck of the instrument, thereby adjusting it to the proper curvature.

By utilizing first and second threaded sections 16, 18 that differ only slightly in thread pitch, the amount of bending induced for a given amount of rotation of the adjuster nut 20 will be quite small. The result is a neck adjusting truss rod that requires less torque to be applied to the adjuster nut and allows more precise adjustments of the curvature of the neck than with previous designs. In addition, the axial orientation of the first and second threaded sections 16, 18 allows the embodiment of FIG. 1 to be quite slender and therefore applicable to a wider variety of instrument styles than previous designs.

Figure 2:
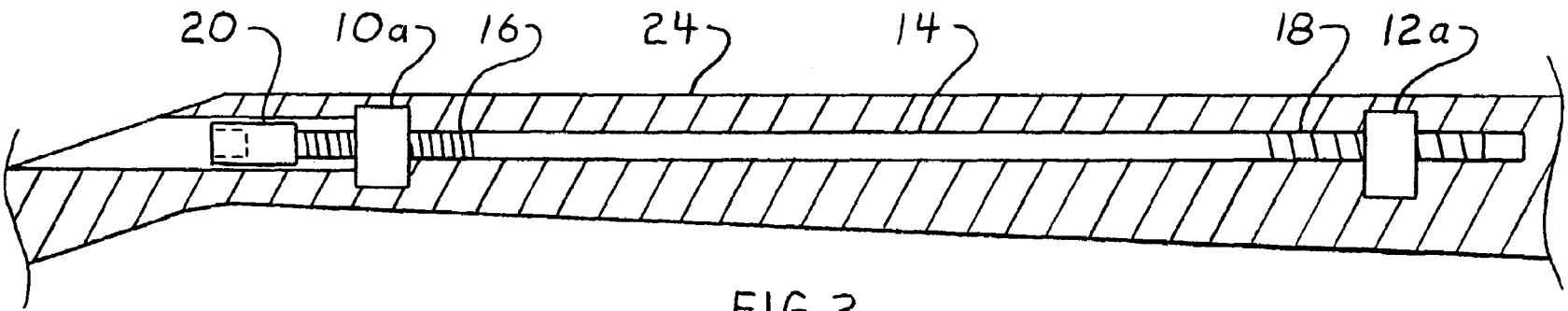
FIG. 2 is a side view of a second embodiment of my invention showing it embedded in a typical stringed instrument neck.

Second Embodiment, FIG. 2

FIG. 2 shows a second embodiment of the invention. The second embodiment is similar to the first embodiment, FIG. 1, except that rather than having the end blocks 10, 12 fixedly attached to a bar 8, FIG. 2 shows the end blocks 10*a*, 12*a* fixedly embedded directly into the neck of the stringed instrument 24.

Operation of Second Embodiment, FIG. 2

Operation of the second embodiment, FIG. 2, is similar to the first embodiment, FIG. 1. In this case, however, the end blocks 10*a*, 12*a* are fixedly embedded, into the instrument neck 24. Rotating the adjustor nut 20 in either direction causes the length of the rod 14 between the first and second end blocks 10*a*, 12*a* to change slightly thereby applying either a compressive or tension a force to the instrument neck 24. This force causes bending of the instrument neck 24, thereby allowing precise adjustment of its curvature.

Third Embodiment, Figure

Figure 3:
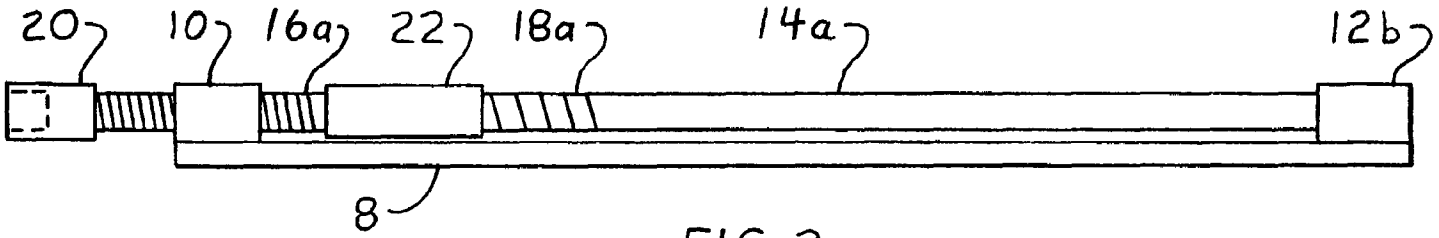
FIG. 3 is a side view of a third embodiment of my invention.

FIG. 3 shows another embodiment of the invention. A first threaded section 16*a* is fixedly attached at its end, such as by welding or brazing, to one end of a collar 22. The first threaded section 16*a* is also theadedly engaged with a first end block 10. A rod 14*a* has a second threaded section 18*a* at one end. The second threaded section 18*a* has similar thread direction to, but differing thread pitch from, the first threaded section 16*a*. The second threaded section 18*a* is threadedly engaged with a similarly threaded end of the collar 22. The other end of the rod 14*a* is fixedly attached to a second end block 12*b*. The first and second end blocks 10, 12*b* are fixedly attached, such as by welding or brazing, to a bar 8. An adjuster nut 20 is provided at the end of the first threaded section 16*a* to facilitate rotating the first threaded section 16*a* and the collar 22 in unison. Enough thread is provided in all threaded locations to allow the adjustor nut 20 to be rotated several full turns in both directions.

Operation of Third Embodiment, FIG. 3

Operation of the third embodiment, FIG. 3, is similar to the first embodiment FIG. 1. The difference being that rotating the adjuster nut 20 in one direction causes the first threaded sections 16*a* to advance through the first end block 10 and also causes the collar 22 to advance, at a different rate, onto the second threaded section 18*a* of bar 14*a*. This in turn causes the distance between the end blocks 10, 12*b* to change slightly, thereby causing the bar 8 to bend.

Figure 4:
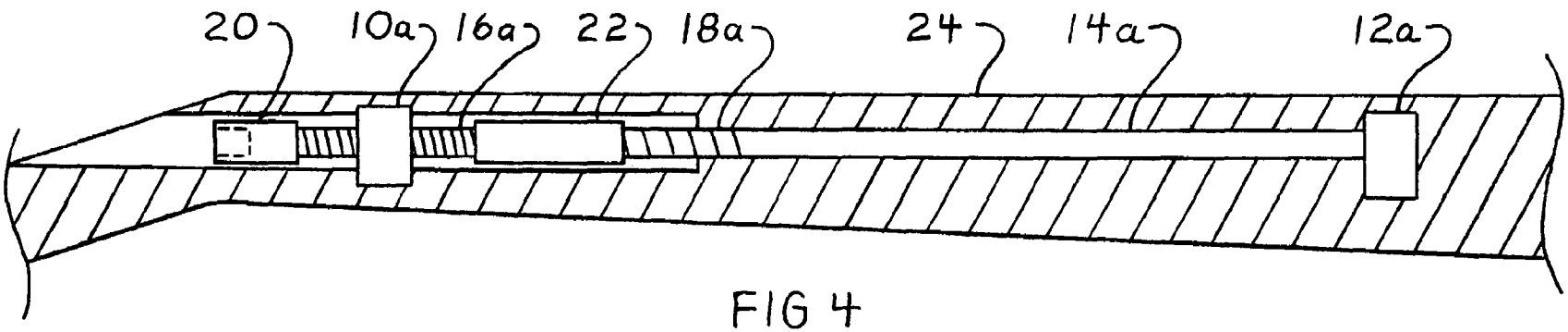
FIG. 4 is a side view of a fourth embodiment of my invention showing it embedded in a typical stringed instrument neck.

Fourth Embodiment, FIG. 4

FIG. 4 shows another embodiment of the invention. The forth embodiment is similar to the third embodiment, FIG. 3, the difference being that rather than having the end blocks 10, 12*b* fixedly attached to the bar 8, FIG. 4 shows the end blocks 10*a*, 12*a* fixedly embedded directly into the neck of the stringed instrument neck 24.

Operation of Fourth Embodiment, FIG. 4

Adjustment of the fourth embodiment, FIG. 4 is similar to that of the third embodiment, FIG. 3. The attachment of the fourth embodiment, FIG. 4, to the neck of the stringed instrument and the manner in which it facilitates neck adjustment is similar to the second embodiment, FIG. 2.

CONCLUSION, RAMIFICATIONS AND SCOPE OF THE INVENTION

Thus the reader will see that at least one of the embodiments provides a neck adjusting truss rod that provides more precise adjusting capabilities and a wider range of application than previous designs.

While my above description contains many specificities, these should not be construed as limitations on the scope of the invention, but rather as examples of possible embodiments thereof. Many other variations are possible. Accordingly, the scope of the invention should be determined not by the embodiments illustrated, but by the appended claims and their legal equivalents.

I claim:

1. A truss rod apparatus for adjusting neck curvature in a stringed musical instrument comprising:

a) a first elongate member, said first elongate member including adjuster means for changing its length, said adjuster means including a first threaded section, a second threaded section and an adjuster nut, said first and second threaded sections being axially oriented and having similar thread direction and differing thread pitch, said adjuster nut being located at one end of said first elongate member and having engagement means by which said adjuster nut may be engaged with a tool for the purpose of rotating it, b) a first end block, said first end block being threadedly engaged with said first threaded section of said adjuster means, and having attachment means by which said first end block may be fixedly attached to a second elongate member, and c) a second end block, said second end block being located at the opposite end of said first elongate member from said first end block, said end block having connection means by which said second end block is connected to said first elongated member, and anchoring means by which said second end block may be anchored to said second elongate member, whereby rotating the adjuster nut induces a small amount of bending in the truss rod thus providing a slimly profiled and precisely adjustable apparatus for adjusting the curvature of a wide variety of stringed musical instrument necks.

2. The truss rod apparatus of claim 1 wherein said first elongate member is a rod, said first threaded section and said second threaded section being located at opposite ends of said rod.

3. The truss rod apparatus of claim 2 wherein said connection means is threaded engagement of said second end block with said second threaded section of said rod.

4. The truss rod apparatus of claim 3 wherein said first and second end blocks are fixedly attached directly to the neck of a stringed instrument adjacent to and parallel with said rod.

5. The truss rod apparatus of claim 3 wherein said first and second end blocks are fixedly attached to an elongate bar adjacent to and parallel with said rod.

6. The truss rod apparatus of claim 5 wherein said elongate bar is rectangular in cross section.

7. The truss rod apparatus of claim 1 wherein said adjuster means includes a rod, said rod having said second threaded section at one end and having the other end fixedly attached to said second end block.

8. The truss rod apparatus of claim 7 wherein said adjuster means includes a collar, said collar being fixedly attached at one end to said first threaded section and being threadedly engaged at the other end to said second threaded section.

9. The truss rod apparatus of claim 8 wherein said first and second end blocks are fixedly attached to the neck of a stringed musical instrument.

10. The truss rod apparatus of claim 8 wherein said first and second end blocks are fixedly attached to an elongate bar adjacent to and parallel with said first elongate member.

11. The truss rod apparatus of claim 10 wherein said elongate bar is rectangular in cross section.

* * * * *